US008715018B2

(12) United States Patent
Yoshikawa

(10) Patent No.: US 8,715,018 B2
(45) Date of Patent: May 6, 2014

(54) TERMINAL STRUCTURE

(71) Applicant: Shuji Yoshikawa, Anjo (JP)

(72) Inventor: Shuji Yoshikawa, Anjo (JP)

(73) Assignee: Makita Corporation, Anjo-shi (JP)

( * ) Notice: Subject to any disclaimer, the term of this patent is extended or adjusted under 35 U.S.C. 154(b) by 35 days.

(21) Appl. No.: 13/665,094

(22) Filed: Oct. 31, 2012

(65) Prior Publication Data

US 2013/0143452 A1 Jun. 6, 2013

(30) Foreign Application Priority Data

Dec. 6, 2011 (JP) ..... 2011-267131

(51) Int. Cl.
*H01R 13/11* (2006.01)

(52) U.S. Cl.
USPC ..... 439/850

(58) Field of Classification Search
USPC ..... 439/842, 850, 862, 863
See application file for complete search history.

(56) References Cited

U.S. PATENT DOCUMENTS

| | | | | |
|---|---|---|---|---|
| 5,197,906 | A | 3/1993 | Watanabe et al. | |
| 5,252,097 | A | 10/1993 | Lindeberg et al. | |
| 6,394,829 | B1 | 5/2002 | Patterson et al. | |
| 6,629,853 | B2 * | 10/2003 | Whiteman, Jr. | 439/246 |
| 7,217,162 | B2 * | 5/2007 | Harada et al. | 439/857 |
| 7,556,509 | B1 * | 7/2009 | Oh et al. | 439/76.2 |

FOREIGN PATENT DOCUMENTS

| | | | |
|---|---|---|---|
| DE | 100 40 893 | A1 | 8/2001 |
| GB | 2 265 769 | A | 10/1993 |
| JP | U-04-38668 | | 3/1992 |
| WO | WO 92/04746 | | 3/1992 |

OTHER PUBLICATIONS

Feb. 5, 2013 Extended Search Report issued in European Application No. 12190572.3.

* cited by examiner

*Primary Examiner* — Khiem Nguyen
(74) *Attorney, Agent, or Firm* — Oliff PLC

(57) ABSTRACT

In a terminal structure, at least one pair of left and right clamp pieces are formed in a terminal in which an electrode is slide-inserted. The left and right clamp pieces elastically press the electrode from both right and left sides when the electrode is inserted in the terminal. A contact piece is formed on at least one of left and right sides of the terminal, and is separated in the slide-insertion direction by a slit from a clamp piece-formed portion where the clamp piece is formed. The clamp piece is elastically deformed to contact the contact piece when the electrode is inserted in the terminal.

7 Claims, 4 Drawing Sheets

TERMINAL STRUCTURE

BACKGROUND OF THE INVENTION

This application claims the benefit of Japanese Patent Application Number 2011-267131 filed on Dec. 6, 2011, the entirety of which is incorporated by reference.

TECHNICAL FIELD

The present invention relates to terminal structures in which a pair of left and right clamp pieces are formed in a terminal in which an electrode is slide-inserted, so that the pair of left and right clamp pieces elastically press the electrode from both right and left sides when the electrode is inserted in the terminal.

BACKGROUND ART

Japanese Utility Model Application Publication No. H04-38668 (JP H04-38668 U) discloses, as a structure in which a battery is mounted on a cordless tool, a technique in which a terminal is provided on both sides of an electrode of the battery so as to extend parallel to a direction in which the battery is inserted into a body of the cordless tool, and a plurality of contact portions that contact the electrode are formed in the terminal. JP H04-38668 U also discloses that a backup spring is provided parallel to the terminal, and a free end of the terminal is pressed toward the electrode by a spring force of the backup spring. The pressing force of the backup spring can increase the contact pressure between the terminal and the electrode of the battery.

In recent years, since there has been a demand for smaller batteries, it is also desired to reduce the size of a structure that connects an electrode of the battery to a terminal. However, the technique disclosed in JP H04-38668 U requires the backup spring in addition to the terminal in order to increase the contact pressure between the terminal and the electrode of the battery, and thus is not suitable for reducing the size of the structure of the terminal to which the electrode is connected. Using no backup spring can reduce the size of the terminal structure, but may not be able to secure the contact pressure between the terminal and the electrode.

SUMMARY OF THE INVENTION

The present invention has been proposed in view of the above problems, and it is an object of the present invention to provide a terminal structure capable of achieving downsizing and capable of securing a contact pressure between an electrode and a terminal.

According to a first aspect of the present invention, a terminal structure includes a terminal in which an electrode is slide-inserted, at least one pair of left and right clamp pieces formed in the terminal so as to elastically press from both left and right sides the electrode inserted in the terminal, and a contact piece that is formed on at least one of left and right sides of the terminal, and is separated, in a slide-insertion direction, by a slit from a clamp piece-formed portion where the clamp piece is formed, wherein the clamp piece is elastically deformed to contact the contact piece when the electrode is inserted in the terminal.

In the terminal structure according to the first aspect of the present invention, the electrode can be pressed by the pair of left and right clamp pieces without using a member separate from the terminal, such as a backup spring. This can reduce the size of the structure of the terminal to which the electrode is connected.

Moreover, when at least one of the left and right clamp pieces is elastically deformed to contact the contact piece with the electrode being pressed between the pair of left and right clamp pieces, the contact piece prevents widening of the gap between the pair of clamp pieces. Accordingly, the contact pressure between the electrode and the pair of clamp pieces can be secured.

DETAILED DESCRIPTION OF THE EMBODIMENTS

First Embodiment

Figure 1:
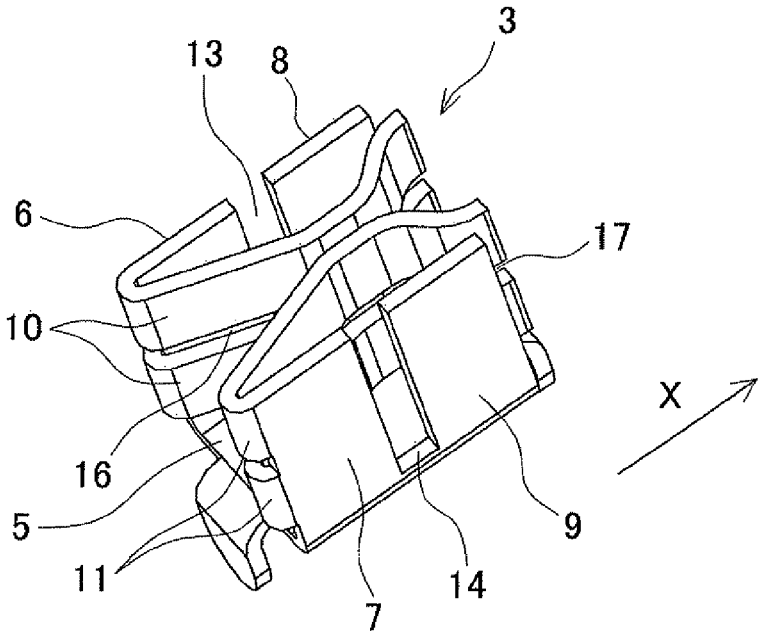
FIG. 1 is a perspective view of a charging and discharging terminal of a first embodiment of the present invention.
Figure 2:
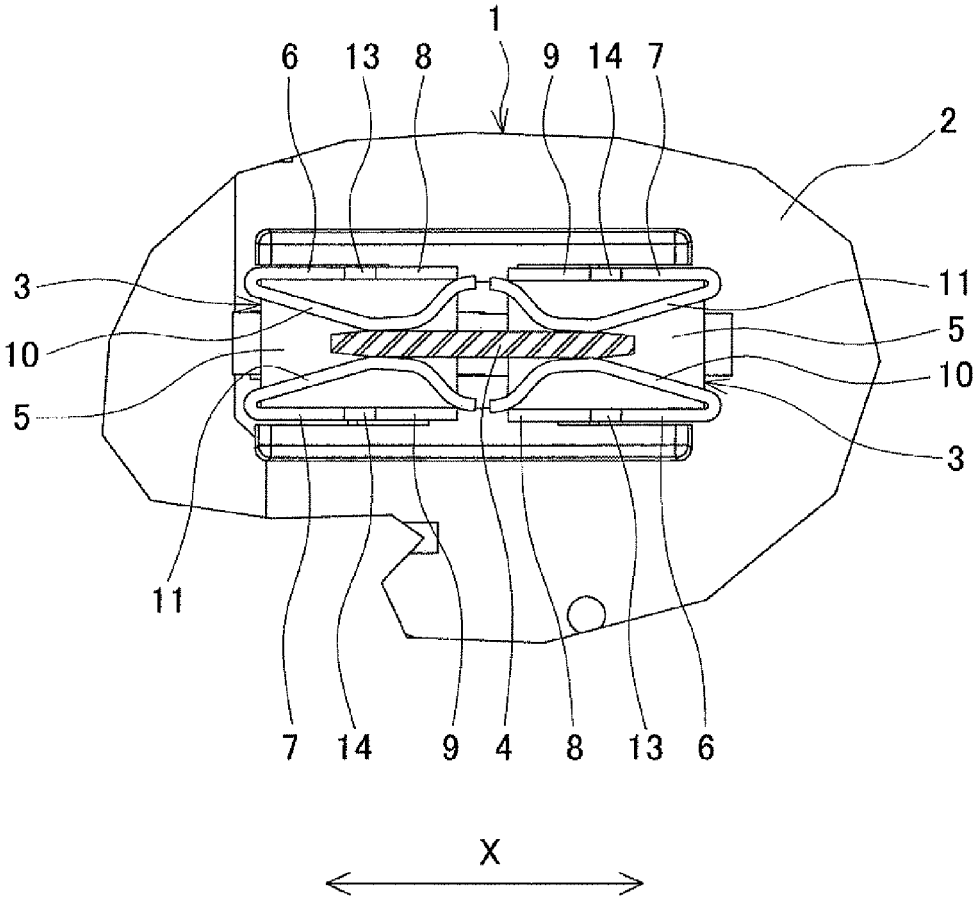
FIG. 2 is a diagram illustrating the state where a terminal plate provided in an electric power tool is pressed by a pair of clamp pieces included in the charging and discharging terminal of the first embodiment.

A first embodiment of the present invention will be described with reference to FIGS. 1 and 2. FIGS. 1 and 2 show a charging and discharging terminal 3 that is placed on a circuit board 2 of a battery pack 1 of an electric power tool. The charging and discharging terminal 3 is a terminal configured so that a terminal plate 4 (see FIG. 2) provided on a lower end face of a handle of the electric power tool is slide-inserted into the charging and discharging terminal 3 and electrically connected to the charging and discharging terminal 3. As shown in FIG. 1, the charging and discharging terminal 3 includes a substrate 5, a pair of left and right sidewall portions 6, 7, a pair of left and right contact pieces 8, 9, and a pair of left and right clamp pieces 10, 11. In the following description, the side located farther from the viewer of the figure is the left side of the charging and discharging terminal 3, and the side located closer to the viewer of the figure is the right side of the charging and discharging terminal 3. The charging and discharging terminal 3 is an example of the "terminal" of the present invention, and the terminal plate 4 is an example of the "electrode" of the present invention.

The substrate 5 is made of a metal, and is formed in a plate shape extending in a slide-insertion direction X, i.e., the direction in which the terminal plate 4 is slide-inserted into the charging and discharging terminal 3 (see FIGS. 1 and 2). The substrate 5 is electrically connected to a storage battery group (not shown). As shown in FIG. 1, the left sidewall portion 6 and the left contact piece 8 are provided so as to stand on a left end of the substrate 5. The left sidewall portion 6 and the left contact piece 8 are connected to the substrate 5. As shown in the figure, the left contact piece 8 is separated in the slide-insertion direction X from the left sidewall portion 6 by a slit 13 that extends in the direction in which the left contact piece 8 and the left sidewall portion 6 stand, The right sidewall portion 7 and the right contact piece 9 are provided so as to stand on a right end of the substrate 5. The right sidewall portion 7 and the right contact piece 9 are also connected to the substrate 5. The right contact piece 9 is also separated in the slide-insertion direction X from the right sidewall portion 7 by a slit 14 that extends in the direction in which the right contact piece 9 and the right sidewall portion 7 stand.

As shown in FIG. 1, the left clamp piece 10 is formed in a strip shape extending from a front end of the left sidewall portion 6 in the slide-insertion direction X so as to face the inner surfaces of the left sidewall portion 6 and the left contact piece 8. The left clamp piece 10 is divided in the vertical direction by a slit 16 that extends in the direction in which the left clamp piece 10 extends. The right clamp piece 11 is formed in a strip shape extending from a front end of the right sidewall portion 7 in the slide-insertion direction X so as to face the inner surfaces of the right sidewall portion 7 and the right contact piece 9. The right clamp piece 11 is also divided in the vertical direction by a slit 17 that extends in the direction in which the right clamp piece 11 extends. The left clamp piece 10 and the right clamp piece 11 face each other on the substrate 5 so as to extend toward each other, and a gap is provided between the left clamp piece 10 and the right clamp piece 11 so that the terminal plate 4 can be inserted and clamped therebetween. A distal end of each clamp piece 10, 11 is bent outward. The left sidewall portion 6 and the right sidewall portion 7 are an example of the "clamp piece-formed portion" of the present invention.

Operation of electrically connecting the terminal plate 4 to the charging and discharging terminal 3 will be described below. In the example shown in FIG. 2, two charging and discharging terminals 3 are symmetrically arranged next to each other in the slide-insertion direction X. As the battery pack 1 is slid along the lower end face of the handle of the electric power tool, the terminal plate 4 is inserted into the gap between the pair of left and right clamp pieces 10, 11 located on the front side in the slide-insertion direction X (the left side in FIG. 2). As the battery pack 1 is further slid in the slide-insertion direction X, the terminal plate 4 is inserted into the gap that is widened against the biasing force of the clamp pieces 10, 11, while being elastically pressed from both left and right sides by the clamp pieces 10, 11. As the gap is widened, the clamp pieces 10, 11 are elastically deformed against the biasing force. As a result, the distal end of the left clamp piece 10 contacts the inner surface of the left contact piece 8, and the distal end of the right clamp piece 11 contacts the inner surface of the right contact piece 9. The pair of left and right contact pieces 8, 9 thus prevent widening of the gap between the clamp pieces 10, 11. Accordingly, the terminal plate 4 is kept being pressed by the clamp pieces 10, 11, whereby a contact pressure between the terminal plate 4 and the clamp pieces 10, 11 can be secured. Thus, the terminal plate 4 can be electrically connected to the clamp pieces 10, 11, As shown in FIG. 2, when the terminal plate 4 is inserted into the gap between the pair of left and right clamp pieces 10, 11 located on the rear side in the slide-insertion direction X (the right side in FIG. 2), the pair of left and right contact pieces 8, 9 similarly prevent widening of the gap between the pair of left and right clamp pieces 10, 11. In this manner, a contact pressure between the terminal plate 4 and the pair of left and right clamp pieces 10, 11 can be secured in each charging and discharging terminal 3.

In the present embodiment, the terminal plate 4 is inserted between the clamp pieces 10, 11 while elastically deforming the clamp pieces 10, 11. This can suppress an increase in sliding friction of the terminal plate 4 against the clamp pieces 10, 11. An increase in the sliding friction when removing the terminal plate 4 from the clamp pieces 10, 11 can also be suppressed, for a reason similar to that in the case of inserting the terminal plate 4 between the clamp pieces 10, 11. Thus, wear of the terminal plate 4 and wear of the clamp pieces 10, 11 can be suppressed.

Effects of First Embodiment

In the charging and discharging terminal 3 of the present embodiment, the terminal plate 4 can be pressed by the pair of left and right clamp pieces 10, 11 without using a member separate from the charging and discharging terminal 3, such as a backup spring. This can reduce the size of the structure of the charging and discharging terminal 3 to which the terminal plate 4 is electrically connected.

Moreover, when the pair of left and right clamp pieces 10, 11 are elastically deformed to contact the pair of left and right contact pieces 8, 9 with the terminal plate 4 being pressed between the clamp pieces 10, 11, the contact pieces 8, 9 prevent widening of the gap between the clamp pieces 10, 11. Accordingly, the contact pressure between the terminal plate 4 and the clamp pieces 10, 11 can be secured.

Second Embodiment

Figure 3:
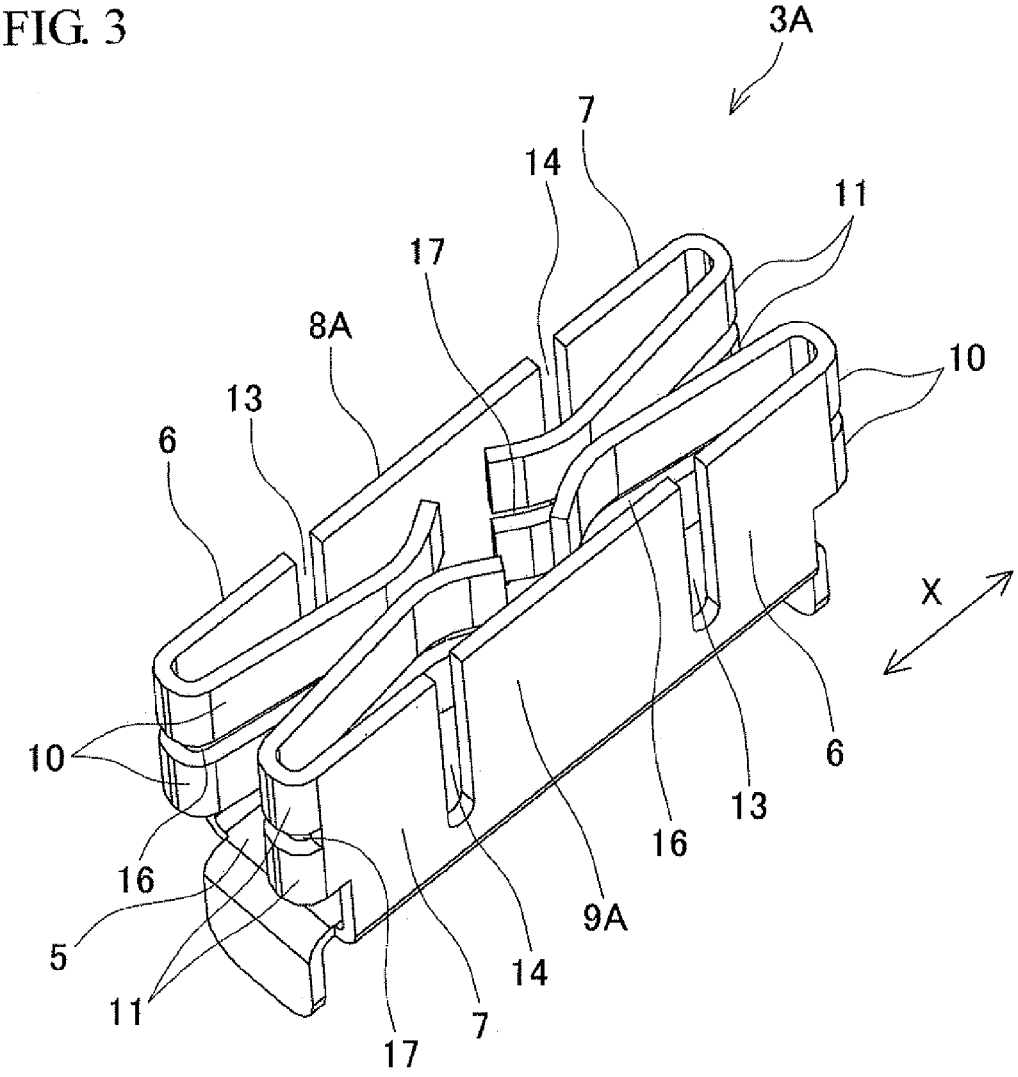
FIG. 3 is a perspective view of a charging and discharging terminal of a second embodiment.

A second embodiment of the present invention will be described below with reference to FIGS. 3 and 4. The same structural elements as those of the first embodiment are denoted with the same reference characters, and description thereof will be omitted. A left contact piece 8A is provided so as to stand on a left end of a substrate 5 of a charging and discharging terminal 3A shown in FIG. 3 and so as to be interposed between sidewall portions 6, 7 in the slide-insertion direction X. A right contact piece 9A is provided so as to stand on a right end of the substrate 5 and so as to be interposed between sidewall portions 7, 6 in the slide-insertion direction X. The charging and discharging terminal 3A is formed so that the left contact piece 8 of one charging and discharging terminal 3 and the right contact piece 9 of the other charging and discharging terminal 3 shown in FIG. 2 are connected together and integral with each other on both the left and right ends of the terminal 5. Thus, unlike the first embodiment, the charging and discharging terminal 3A to which the terminal plate 4 is to be electrically connected is formed without dividing the charging and discharging terminal into two terminals. This can simplify the processing as compared to the charging and discharging terminal 3 of the first embodiment.

Operation of electrically connecting the terminal plate 4 to the charging and discharging terminal 3A will be described below. As the battery pack 1 is slid along the lower end face of the handle of the electric power tool, the terminal plate 4 is elastically pressed from both left and right sides by a pair of left and right clamp pieces 10, 11 located on the front side in the slide-insertion direction X (the left side in FIG. 4), as in the first embodiment. At this time, a distal end of the left clamp piece 10 contacts the inner surface of the left contact piece 8A, and a distal end of the right clamp piece 11 contacts the inner surface of the right contact piece 9A. As a result, as in the first embodiment, the terminal plate 4 is kept being pressed by the clamp pieces 10, 11, whereby a contact pressure between the terminal plate 4 and the clamp pieces 10, 11 can be secured.

Figure 4:
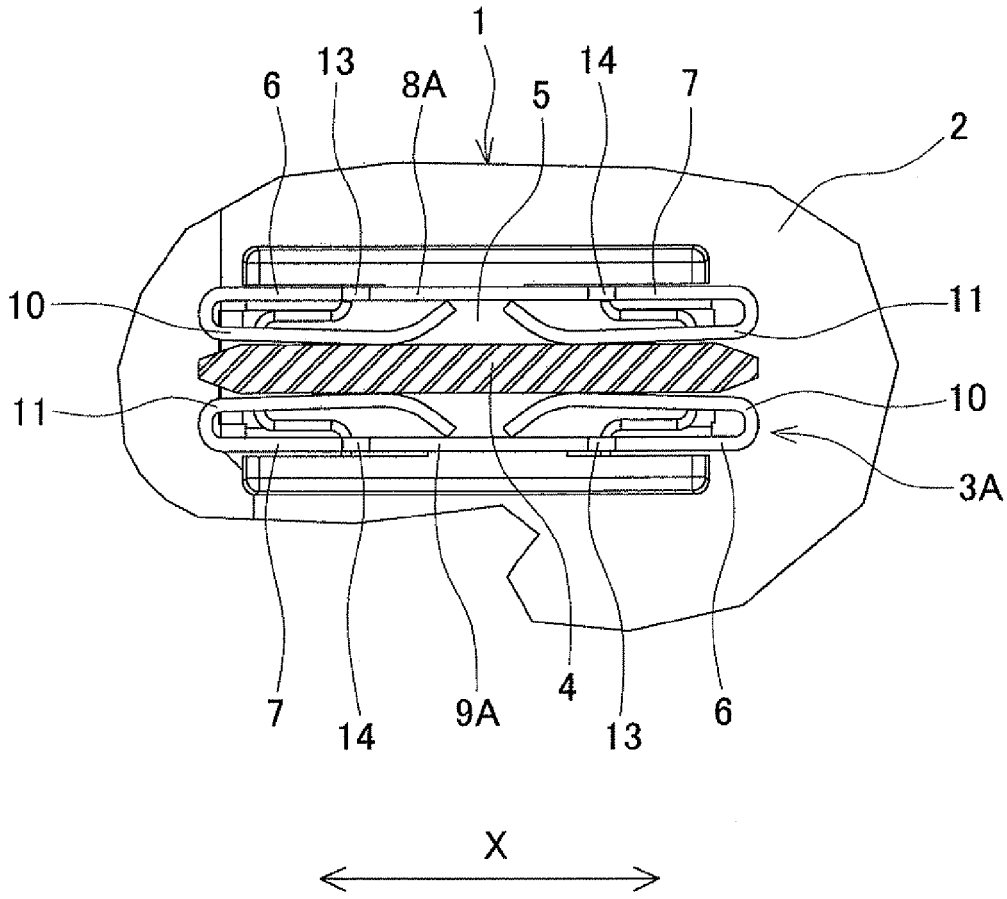
FIG. 4 is a diagram illustrating the state where the terminal plate is pressed by two pairs of clamp pieces included in the charging and discharging terminal of the second embodiment.

As shown in FIG. 4, in the charging and discharging terminal 3A, when the terminal plate 4 is inserted into the gap between a pair of left and right clamp pieces 10, 11 located on the rear side in the slide-insertion direction X (the right side in FIG. 4), the terminal plate 4 is elastically pressed from both left and right sides by these rear clamp pieces 10, 11, as in the case where the terminal plate 4 is inserted into the gap between the damp pieces 10, 11 located on the front side in the slide-insertion direction X. In this case as well, a distal end of the rear left clamp piece 10 contacts the inner surface of the right contact piece 9A, and a distal end of the rear right clamp piece 11 contacts the inner surface of the left contact piece 8A. As a result, a contact pressure between the terminal plate 4 and the rear clamp pieces 10, 11 can also be secured. Thus, in the charging and discharging terminal 3A, the contact pressure between the terminal plate 4 and the two pairs of clamp pieces (the front clamp pieces 10, 11 and the rear clamp pieces 10, 11) can be secured.

Effects of Second Embodiment

In the charging and discharging terminal 3A of the present embodiment, the terminal plate 4 can be pressed by the two pairs of left and right clamp pieces (the front clamp pieces 10, 11 and the rear clamp pieces 10, 11) without using a member separate from the charging and discharging terminal 3A, such as a backup spring. This can reduce the size of the structure of the charging and discharging terminal 3A to which the terminal plate 4 is electrically connected.

Moreover, with the terminal plate 4 being pressed by the two pairs of left and right clamp pieces 10, 11, the front left clamp piece 10 and the rear right clamp piece 11 are elastically deformed to contact the left contact piece 8A, and the front right clamp piece 11 and the rear left clamp piece 10 are elastically deformed to contact the right contact piece 9A. Thus, the contact pieces 8A, 9A prevent widening of the gap between the front clamp pieces 10, 11 and the gap between the rear clamp pieces 10, 11. Accordingly, the contact pressure between the terminal plate 4 and the two pairs of left and right clamp pieces 10, 11 can be secured.

The present invention is not limited to the above embodiments, and the configuration can be partially changed as appropriate without departing from the scope of the invention. Although the first embodiment is described for an example in which the two charging and discharging elements 3 are arranged next to each other in the slide-insertion direction X. Alternatively, however, one charging and discharging element 3 may be placed on the circuit board 2 so that the terminal plate 4 is pressed by the pair of left and right clamp pieces 10, 11 included in this charging and discharging element 3.

Unlike the first embodiment, the charging and discharging terminal may be structured so that both the sidewall portion and the contact piece stand only on the left end of the substrate 5 and only the sidewall portion stands on the right end of the substrate 5, or may be structured so that both the sidewall portion and the contact piece stand only on the right end of the substrate 5 and only the sidewall portion stands on the left end of the substrate 5. Moreover, unlike the second embodiment, the charging and discharging terminal may be structured so that the contact piece stands only on the left end of the substrate 5 so as to be interposed between the two sidewall portions in the slide-insertion direction X, and the two sidewall portions separated from each other in the slide-insertion direction X with no contact piece therebetween stand on the right end of the substrate 5. On the contrary, the charging and discharging terminal may be structured so that the contact piece stands only on the right end of the substrate 5 so as to be interposed between the two sidewall portions in the slide-insertion direction X, and the two sidewall portions separated from each other in the slide-insertion direction X with no contact piece therebetween stand on the left end of the substrate 5.

The above embodiment is described for an example in which the present invention is applied to the case where the terminal plate of the electric power tool is electrically connected to the charging and discharging terminal of the battery pack. However, the present invention is not limited to this, and the present invention may be applied to a structure that electrically connects an electrode to a terminal in which the electrode is slide-inserted, in a portion where reduction in size of the terminal structure is required.

It is explicitly stated that all features disclosed in the description and/or the claims are intended to be disclosed separately and independently from each other for the purpose of original disclosure as well as for the purpose of restricting the claimed invention independent of the composition of the features in the embodiments and/or the claims. It is explicitly stated that all value ranges or indications of groups of entities disclose every possible intermediate value or intermediate entity for the purpose of original disclosure as well as for the purpose of restricting the claimed invention, in particular as limits of value ranges.

What is claimed is:

1. A terminal structure, comprising:

a terminal in which an electrode is slide-inserted;

at least one pair of left and right clamp pieces formed in the terminal so as to elastically press from both left and right sides the electrode inserted in the terminal; and a contact piece that is formed on at least one of left and right sides of the terminal, and is separated in a slide-insertion direction by a slit from a clamp piece-formed portion where the clamp piece is formed, wherein the clamp piece is elastically deformed to contact the contact piece when the electrode is inserted in the terminal.

2. The terminal structure according to claim 1, wherein the clamp piece-formed portion and the contact piece are provided so as to stand at each of left and right ends of a substrate having a plate shape and extending in the slide-insertion direction.

3. The terminal structure according to claim 2, wherein the slit is formed in a same direction as a direction in which the clamp piece-formed portion stands and a direction in which the contact piece stands.

4. The terminal structure according to claim 2, wherein each of the clamp pieces is formed in a strip shape extending in the slide-insertion direction from a front end face, in the slide-insertion direction, of the clamp piece-formed portion, so that the clamp piece faces an inner surface of the clamp piece-formed portion and an inner surface of the contact piece.

5. The terminal structure according to claim 4, wherein each of the clamp pieces is divided in a vertical direction thereof by a slit extending in a direction in which the clamp piece extends.

6. The terminal structure according to claim 4, wherein a distal end of each of the clamp pieces is bent toward the inner surface of the contact piece.

7. The terminal structure according to claim 1, wherein the contact piece is provided so as to be interposed, in the slide-insertion direction via the slits, between two of the clamp piece-formed portions, and the electrode is elastically pressed from the left and right sides by the pair of left and right clamp pieces formed in the clamp piece-formed portions located on a front side in the slide-insertion direction, and the pair of left and right clamp pieces formed in the clamp piece-formed portions located on a rear side in the slide-insertion direction.

* * * * *